US012497261B2

(12) United States Patent
Bosoku et al.

(10) Patent No.: US 12,497,261 B2
(45) Date of Patent: Dec. 16, 2025

(54) PROCESSING DEVICE AND RECORDING DEVICE

(71) Applicant: SEIKO EPSON CORPORATION, Tokyo (JP)

(72) Inventors: Makoto Bosoku, Matsumoto (JP); Shun Ito, Matsumoto (JP); Atsuhiko Takeuchi, Matsumoto (JP); Yosuke Nakano, Matsumoto (JP); Mitsuru Murata, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 104 days.

(21) Appl. No.: 18/515,744

(22) Filed: Nov. 21, 2023

(65) Prior Publication Data

US 2024/0166458 A1 May 23, 2024

(30) Foreign Application Priority Data

Nov. 21, 2022 (JP) ..... 2022-185563

(51) Int. Cl.
*B65H 31/20* (2006.01)
*B65H 31/02* (2006.01)

(52) U.S. Cl.
CPC ..... *B65H 31/20* (2013.01); *B65H 31/02* (2013.01); *B65H 2402/30* (2013.01); *B65H 2402/32* (2013.01); *B65H 2402/33* (2013.01); *B65H 2403/41* (2013.01); *B65H 2403/48* (2013.01); *B65H 2405/324* (2013.01); *B65H 2701/11312* (2013.01); *B65H 2801/36* (2013.01)

(58) Field of Classification Search
CPC ..... B65H 31/20; B65H 31/02; B65H 31/22; B65H 2701/11312; B65H 2801/36; B65H 2401/14
See application file for complete search history.

(56) References Cited

U.S. PATENT DOCUMENTS

| | | | | |
|---|---|---|---|---|
| 11,565,540 | B2 * | 1/2023 | Yato | B41J 13/0009 |
| 11,591,176 | B2 * | 2/2023 | de la Hoz Matveeva | B65H 31/20 |
| 12,269,261 | B2 * | 4/2025 | Bosoku | B41J 15/046 |
| 2015/0273897 | A1 | 10/2015 | Kato et al. | |
| 2022/0111668 | A1 | 4/2022 | Yato et al. | |
| 2024/0149594 | A1 * | 5/2024 | Bosoku | B41J 13/106 |

FOREIGN PATENT DOCUMENTS

| | | |
|---|---|---|
| JP | 2015-189559 A | 11/2015 |
| JP | 2022-064292 A | 4/2022 |

* cited by examiner

*Primary Examiner* — Jeremy R Severson
(74) *Attorney, Agent, or Firm* — Dority & Manning, P.A.

(57) ABSTRACT

A processing device includes a processing section and a medium receiving section, wherein the medium receiving section has a sheet-like receiving member having flexibility, a pivot shaft coupled to one end of the receiving member, an operation section coupled to the other end of the receiving member and provided separable from the pivot shaft, and a pair of support sections that support both ends of the operation section, and the receiving member is wound around the pivot shaft and housed inside of the housing when the operation section approaches the pivot shaft, and is unwound from the pivot shaft and hangs down receivable the medium when the operation section is separated from the pivot shaft, and is wound around the pivot shaft such that contacting side with the medium is an inner side when the receiving member is wound around the pivot shaft.

5 Claims, 9 Drawing Sheets

PROCESSING DEVICE AND RECORDING DEVICE

The present application is based on, and claims priority from JP Application Serial Number 2022-185563, filed Nov. 21, 2022, the disclosure of which is hereby incorporated by reference herein in its entirety.

BACKGROUND

1. Technical Field

The present disclosure relates to a processing device and a recording device.

2. Related Art

In related art, various processing devices such as a recording device, or the like, have been used as a processing device that performs processing on a medium. Among them, there is a processing device having a medium receiving section for receiving a processed medium. For example, JP-A-2022-64292 discloses a processing device including a medium receiving section having a sheet-like receiving member that is housed inside a housing when not receiving medium, and can be fed to a position where medium can be received when receiving medium.

In JP-A-2022-64292, the medium receiving section of the processing device includes a sheet-like receiving member that can be accommodated inside the housing and a pivot shaft, and is configured to receive the medium discharged from the housing by feeding the receiving member from the pivot shaft. In the medium receiving section having such a configuration, there is a concern that the receiving member is not normally fed out depending on material, flexibility, or the like of the receiving member. This is because, for example, the receiving member vigorously jumps upward at the initial stage of the feeding of the receiving member and is caught in by the operation section or the like, and thereafter, when the receiving member wound around the pivot shaft is fed by the movement of the operation section, the outer receiving member wound around the pivot shaft does not follow the rotation of the pivot shaft or the rotation of the inner receiving member. In addition, as another example, this is because the frictional resistance when the receiving member comes into contact with the constituent member of the processing device is too large with respect to the mass of the receiving member, the receiving member does not easily fall, and the feeding amount of the receiving member is insufficient.

SUMMARY

A processing device of the present disclosure, for solving the above problems, includes a processing section that is housed in a housing and processes a medium, and a medium receiving section that receives the medium discharged from the housing, wherein the medium receiving section has a sheet-like receiving member having flexibility, a pivot shaft provided inside the housing and coupled to one end of the receiving member, an operation section coupled to the other end of the receiving member and provided separable from the pivot shaft, and a pair of support sections that protrude from the housing advanceably and retractably in an advancing and retracting direction along a direction in which the operation section is separated from the pivot shaft, and that support both ends of the operation section and the receiving member is wound around the pivot shaft and housed inside of the housing when the operation section approaches the pivot shaft, and is unwound from the pivot shaft and hangs down receivable the medium when the operation section is separated from the pivot shaft, and is wound around the pivot shaft such that contacting side with the medium is an inner side when the receiving member is wound around the pivot shaft.

A recording device of the present disclosure for solving the above problems includes a recording section that is housed in the housing and performs recording on a medium, and a medium receiving section that receives the medium discharged from the housing, wherein the medium receiving section has a sheet-like receiving member having flexibility, a pivot shaft provided inside the housing and coupled to one end of the receiving member, an operation section coupled to the other end of the receiving member and provided separable from the pivot shaft, and a pair of support sections that protrude from the housing advanceably and retractably in an advancing and retracting direction along a direction in which the operation section is separated from the pivot shaft, and that support both ends of the operation section and the receiving member is wound around the pivot shaft and housed inside of the housing when the operation section approaches the pivot shaft, and is unwound from the pivot shaft and hangs down receivable the medium when the operation section is separated from the pivot shaft, and is wound around the pivot shaft such that contacting side with the medium is an inner side when the receiving member is wound around the pivot shaft.

DESCRIPTION OF EMBODIMENTS

Figure 1:
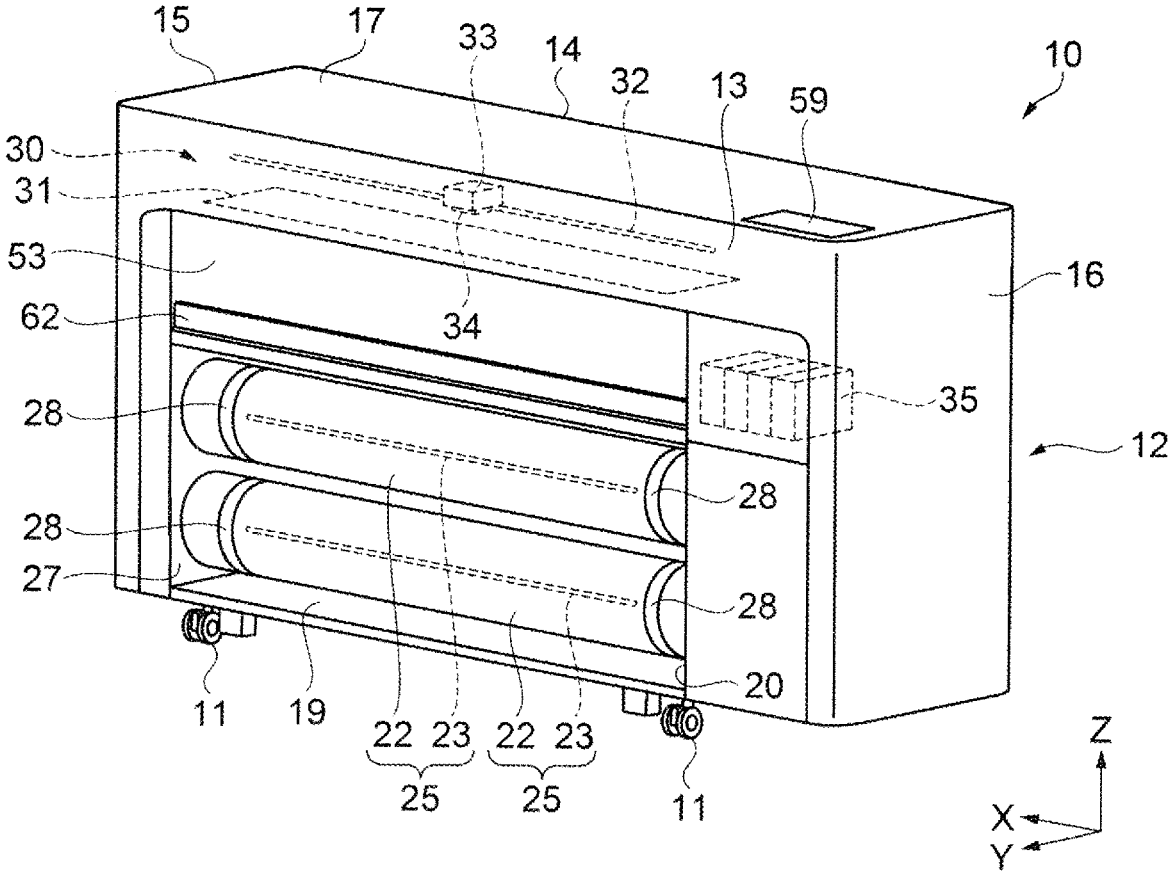
FIG. 1 is a perspective view showing configuration of a recording device according to a first embodiment as a processing device according to an embodiment, and illustrates a state (mounted state) in which an operation section is most advanced into a front wall of a housing.

First, the present disclosure will be generally described.

A processing device according to the first aspect of the present disclosure, for solving the above problems, includes a processing section that is housed in a housing and processes a medium, and a medium receiving section that receives the medium discharged from the housing, wherein the medium receiving section has a sheet-like receiving member having flexibility, a pivot shaft provided inside the housing and coupled to one end of the receiving member, an operation section coupled to the other end of the receiving member and provided separable from the pivot shaft, and a pair of support sections that protrude from the housing advanceably and retractably in an advancing and retracting direction along a direction in which the operation section is separated from the pivot shaft, and that support both ends of the operation section and the receiving member is wound around the pivot shaft and housed inside of the housing when the operation section approaches the pivot shaft, and is unwound from the pivot shaft and hangs down receivable the medium when the operation section is separated from the pivot shaft, and is wound around the pivot shaft such that contacting side with the medium is an inner side when the receiving member is wound around the pivot shaft.

According to this aspect, the sheet-like receiving member for receiving the medium is wound around the pivot shaft and housed in the housing when the operation section approaches the pivot shaft, and is fed out from the pivot shaft and hung downward when the operating section is separated from the pivot shaft, so that the receiving member can receive the medium. When the recording medium is wound around the pivot shaft, the recording medium is wound around the pivot shaft in such a manner that the contacting side of the recording medium with the recording medium faces inward. That is, the pivot shaft is positioned on the inner side (the side on which the medium is received) of the medium receiving section that receives the medium with respect to the sheet-like receiving member having flexibility. For this reason, when the operation section is separated from the pivot shaft, the receiving member is not fed so as to jump out above the pivot shaft. With such a configuration, it is possible to effectively extend the receiving member from the pivot shaft and hang the receiving member downward. Therefore, the receiving member can be suitably fed out.

A processing device according to a second aspect of the disclosure is an aspect according to the first aspect, wherein when the operation section is separated from the pivot shaft, the receiving member is fed out from a lower side of the pivot shaft.

According to this aspect, when the operation section is separated from the pivot shaft, the receiving member is fed out from the lower side of the pivot shaft. Therefore, it is possible to effectively feed out the receiving member from the pivot shaft and hang the receiving member downward, and it is possible to suitably feed out the receiving member.

A processing device according to a third aspect of the disclosure is an aspect according to the first aspect, further includes a rack provided on at least one of the pair of support sections, and a pivot shaft gear provided on the pivot shaft and rotatable in conjunction with the movement of the rack.

According to this aspect of the present disclosure, the rack and the pivot shaft gear are provided. The rack is provided on at least one of the pair of support sections, and the pivot shaft gear is provided on the pivot shaft and rotates in conjunction with the movement of the rack. With such a configuration, it is possible to easily form a configuration in which the pivot shaft rotates in conjunction with the operation of the operation section.

A processing device according to a fourth aspect of the disclosure is an aspect according to the first aspect, further includes a speed enhancement mechanism provided between the rack and the pivot shaft gear, and increases the speed of the rotation of the pivot shaft gear to make the amount of feeding of the receiving member larger than the amount of movement of the pair of support sections.

According to this aspect, the speed enhancement mechanism is provided between the rack and the pivot shaft gear. With such a configuration, it is possible to eliminate the need to increase the size of the pivot shaft for winding the receiving member, and it is possible to reduce the size of the apparatus.

A processing device according to a fifth aspect of the disclosure is an aspect according to the first aspect, wherein the pivot shaft is configured to be further rotatable by a half-rotation or more from a position at which a feeding amount of the receiving member is maximum.

According to this aspect, the pivot shaft is configured to be further rotatable by a half-rotation or more from the position where the feeding amount of the receiving member is maximum. At the end of the feeding of the receiving member, the frictional resistance when the receiving member comes into contact with the constituent members of the processing device tends to increase, making it difficult to feed out the receiving member, but with such a configuration, the receiving member can be suitably fed out even at the end of the feeding of the receiving member.

A recording device according to a sixth aspect of the disclosure includes a recording section that is housed in the housing and performs recording on a medium, and a medium receiving section that receives the medium discharged from the housing, wherein the medium receiving section has sheet-like receiving member having flexibility, a pivot shaft provided inside the housing and coupled to one end of the receiving member, an operation section coupled to the other end of the receiving member and provided separable from the pivot shaft, and a pair of support sections that protrude from the housing advanceably and retractably in an advancing and retracting direction along a direction in which the operation section is separated from the pivot shaft, and that support both ends of the operation section and the receiving member is wound around the pivot shaft and housed inside of the housing when the operation section approaches the pivot shaft, and is unwound from the pivot shaft and hangs down receivable the medium when the operation section is separated from the pivot shaft, and is wound around the pivot shaft such that contacting side with the medium is an inner side when the receiving member is wound around the pivot shaft.

According to this aspect, the sheet-like receiving member for receiving the medium is wound around the pivot shaft and housed in the housing when the operation section approaches the pivot shaft, and is fed out from the pivot shaft and hung downward when the operating section is separated from the pivot shaft, so that the receiving member can receive the medium. When the recording medium is wound around the pivot shaft, the recording medium is wound around the pivot shaft in such a manner that the contacting side of the recording medium with the recording medium faces inward. That is, the pivot shaft is positioned on the inner side (the side on which the medium is received) of the medium receiving section that receives the medium with respect to the sheet-like receiving member having flexibility. Therefore, when the operation section is separated from the pivot shaft, the receiving member is not fed out so as to jump out above the pivot shaft. With such a configuration, it is possible to effectively extend the receiving member from the pivot shaft and hang the receiving member downward. Therefore, the receiving member can be suitably fed out.

First Embodiment

Embodiments of the present disclosure will be specifically described below with reference to the drawings. First, a schematic configuration of a recording device 10 of the first embodiment as a processing device according to an embodiment of the present disclosure will be described with reference to FIGS. 1 to 8. In the coordinates shown in the drawings, it is assumed that the recording device 10 is placed on a horizontal installation surface, and three virtual axes orthogonal to each other are an X-axis, a Y-axis, and a Z-axis. The X-axis is an imaginary axis parallel to the left-right direction of the recording device 10. The Y axis is a virtual axis parallel to the front-rear direction of the recording device 10. The Z-axis is an imaginary axis parallel to the height direction of the recording device 10. The distal end side of the arrow indicating the X-axis, the Y-axis, and the Z-axis is referred to as "+ side", and the proximal end side thereof is referred to as "− side". The recording device 10 includes a recording section 30 that performs recording on a medium as a processing section. The recording device 10 of the present embodiment is a large format printer that performs recording by an inkjet method by feeding out an elongated medium 22 wound in a roll shape. The large format printer is a printer capable of performing recording on an elongated medium having a width of 297 mm or more corresponding to the width of the short side of the A3 size.

Figure 2:
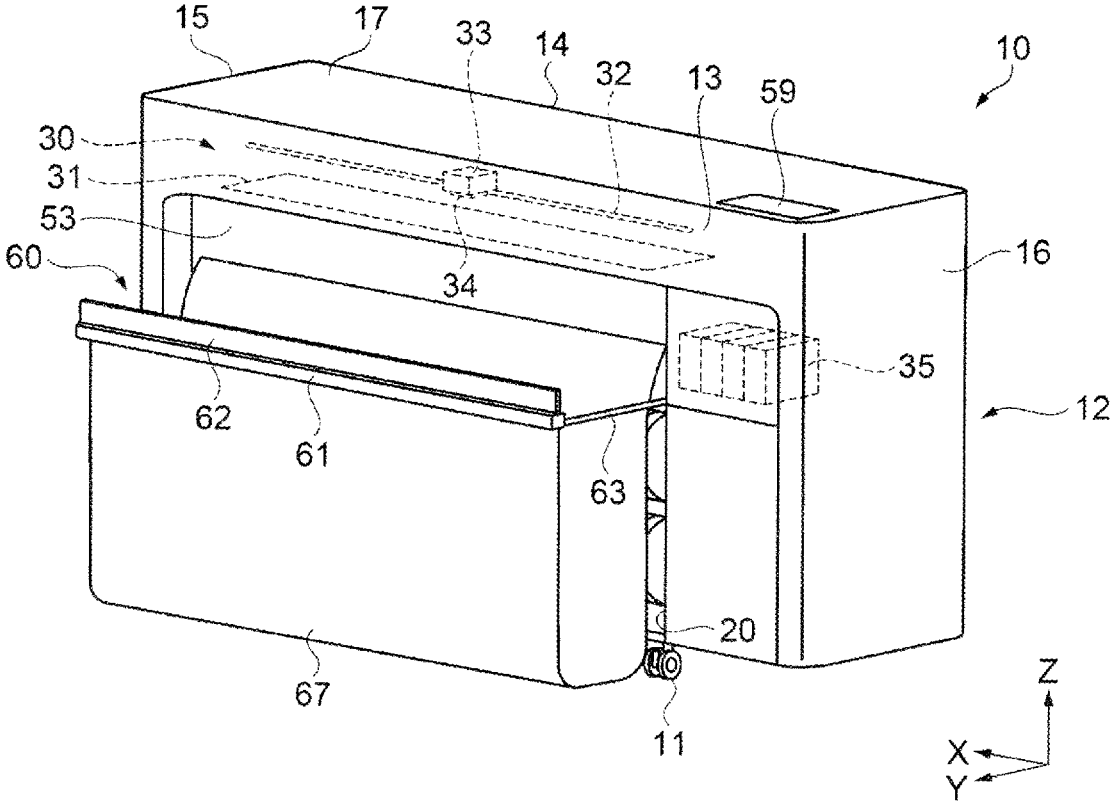
FIG. 2 is a perspective view showing the recording device according to the first embodiment in a state (separated state) in which the operation section is most retracted from the front wall of the housing.
Figure 3:
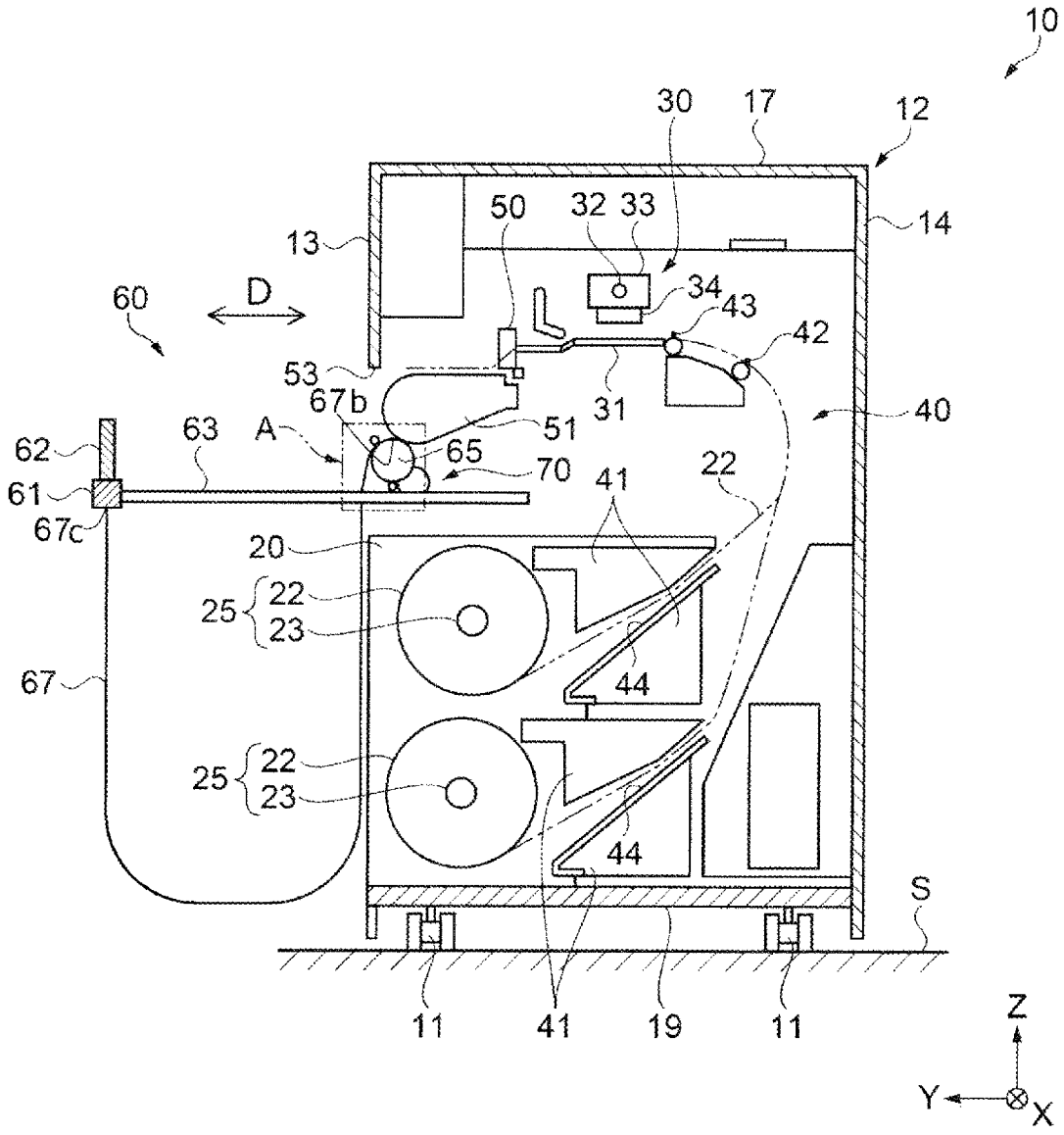
FIG. 3 is a cross-sectional view showing an internal configuration of the recording device according to the first embodiment in a separated state.

As shown in FIGS. 1, 2, and 3, the recording device 10 is housed in a housing 12 and includes the recording section 30 for recording on the medium 22, and a medium receiving section 60 for receiving the medium 22 discharged from the housing 12.

The recording device 10 includes the housing 12 having a substantially rectangular parallelepiped shape elongated in the left-right direction. The housing 12 includes a front wall 13, a rear wall 14, a first side wall 15, a second side wall 16, and a top wall 17. The housing 12 is coupled to a base frame 19 supported by a leg section 11. The recording device 10 is installed on the installation surface S via the leg section 11. In the recording device 10, the Z direction, in which the base frame 19 and the top wall 17 face each other, is the height direction of the recording device 10. The X direction, in which the first side wall 15 and the second side wall 16 face each other, is the left-right direction of the recording device 10. The Y direction, in which the front wall 13 and the rear wall 14 face each other, is the front-rear direction of the recording device 10. When the recording device 10 is disposed on a horizontal plane, the Z direction is a direction parallel to a vertical line. The X direction corresponds to the width direction and also corresponds to the axial direction of a pivot shaft 65 to be described later.

In addition to the recording section 30 that performs recording on the medium 22, an accommodation section 20 that accommodates a roll body 25 in which the medium 22 is wound in a cylindrical shape, a transporting section 40 that transports the medium 22, and a cutting section 50 that cuts the medium 22 are provided inside the housing 12.

A plurality of openings are formed in the front wall 13 of the housing 12. A roll body accommodating port 27 for accommodating the roll body 25 is formed below the front wall 13 on the side of the base frame 19. An opening 53 having functions of a discharge port for discharging the recorded medium 22 and a feeding out port for receiving the discharged medium 22 and feeding out a receiving member 67 described later is formed on the upper side of the roll body accommodating port 27. The medium 22 is discharged from the upper side of the opening 53, and the receiving member 67 is fed out from the lower side of the opening 53. In the present embodiment, a configuration in which the paper discharge opening and the feeding out opening are formed by one opening 53 is illustrated, but a configuration in which the paper discharge opening and the feeding out opening are provided independently of each other may be used.

The cylindrical roll body 25 formed by winding the elongated medium 22 around a core member 23 is detachably housed in the accommodation section 20 from the roll body accommodating port 27. In the present embodiment, the accommodation section 20 is configured to accommodate the two roll bodies 25 elongated in the X direction in a state where the roll bodies 25 are arranged in the Z direction. A pair of holding members 28 rotatably holding the roll body 25 with respect to the accommodation section 20 are attached to both ends of the roll body 25. When the roll body 25 is rotationally driven, the medium 22 wound around the roll body 25 is fed out to the rear wall 14 side in the housing 12.

The transporting section 40 transports the medium 22 delivered from the roll body 25. The transporting section 40 has a transport path forming section 41, an intermediate roller 42, and a transporting roller 43. The transport path forming section 41 is provided corresponding to each of the two roll bodies 25. The transport path forming section 41 is located on the side of the rear wall 14 with respect to each of the two roll bodies 25 accommodated in the accommodation section 20. The transport path forming section 41 forms a transporting path 44 for guiding the medium 22 delivered from the roll body 25 by the rotational drive of the roll body 25 to the side of the rear wall 14 of the housing 12.

The intermediate roller 42 and the transporting roller 43 transport the medium 22 that has passed through the transporting path 44 to the recording section 30. The intermediate roller 42 and the transporting roller 43 are constituted by a driving roller and a driven roller which are a pair of rollers rotatably supported with an axis along the X direction as the pivot shaft. The intermediate roller 42 and the transporting roller 43 sandwich and hold the medium 22 from both the front and back surfaces by the driving roller and the driven roller. When the driving rollers of the intermediate roller 42 and the transporting roller 43 are rotationally driven, the medium 22 is transported to a support base 31 through the transporting path 44, and is transported on the support base 31 from the rear wall 14 side to the front wall 13 side. Although FIG. 3 shows a state in which the medium 22 is fed from both of the two roll bodies 25, the medium 22 is supplied from either one of the two roll bodies 25 during actual recording.

The recording section 30 includes the support base 31, a guide shaft 32, a carriage 33, and a recording head 34. The support base 31 is located closer to the top wall 17 than the accommodation section 20. The support base 31 is a plate-shaped member extending in the X direction in the housing 12, and supports the medium 22 transported by the transporting section 40. The guide shaft 32 is positioned closer to the top wall 17 than the support base 31. The guide shaft 32 is a rod-shaped member extending in the X direction. The guide shaft 32 slidably supports the carriage 33.

The recording head 34 is mounted on the carriage 33. The recording head 34 is positioned on the support base 31 side with respect to the carriage 33. The recording head 34 is configured to reciprocate along the guide shaft 32 together with the carriage 33. The recording head 34 is coupled to a cartridge 35 containing ink by a flexible tube (not shown). The cartridge 35 is accommodated at a position closer to the second side wall 16 than the accommodation section 20 and closer to the top wall 17 than the accommodation section 20. The recording head 34 performs recording on the medium 22 by discharging ink onto the medium 22 supported by the support base 31 while moving in the X direction.

The cutting section 50 is located closer to the front wall 13 than the recording section 30. The cutting section 50 includes a fixed blade and a movable blade that is movable with respect to the fixed blade, and cuts the medium 22 located between the fixed blade and the movable blade. The cut medium 22 is supported by a sheet discharge port member 51 that guides the medium 22 to the upper side of the opening 53 formed in the front wall 13, and is discharged to the outside of the housing 12.

The recording device 10 further includes an input section 59. The input section 59 is provided on the upper surface of the top wall 17 of the housing 12. The input section 59 is located at a corner formed by a portion where the front wall 13 is coupled to the top wall 17 and a portion where the second side wall 16 is coupled to the top wall 17. The input section 59 is constituted by, for example, a liquid crystal display device having a touch panel, and is used when a user inputs various kinds of information.

As shown in FIG. 3 and the like, the medium receiving section 60 includes an operation section 61, a support section 63, the pivot shaft 65, the receiving member 67, and the like. The pivot shaft 65 is provided between the accommodation section 20 and the sheet discharge port member 51 inside the housing 12. The pivot shaft 65 has a cylindrical shape elongated in the X direction, and the length thereof is longer than the width of the medium 22. The pivot shaft 65 is rotatably supported with respect to the housing 12.

The operation section 61 is a rod-shaped member that is long in the X direction. Both ends of the operation section 61 are supported by the pair of support sections 63 which protrude from the side of the front wall 13 of the housing 12 advanceably and retractably in the +Y direction. The pair of support sections 63 protrude to the outside of the housing 12 from between the pivot shaft 65 and the accommodation section 20. That is, the operation section 61 is separable from the housing 12, and is displaceable between a mounted state in which the operation section 61 is mounted on the housing 12 and a separated state in which the operation section 61 is separated from the housing 12 as the pair of support sections 63 move forward and backward.

The receiving member 67 is an elongated sheet-like member having flexibility. As shown in FIGS. 3 to 6, one end 67*b* of the receiving member 67 is coupled to the pivot shaft 65, and the other end 67*c* of the receiving member 67 is coupled to the coupling section 61*a* of the operation section 61. The receiving member 67 is supported upward from the coupling section 61*a* along a front plate 62, and extends to the pivot shaft 65 from a position, in the Z direction, between a horizontal line CL2 intersecting the axial line of the pivot shaft 65 and the uppermost end of the pivot shaft 65. The pivot shaft 65 is configured to rotate forward or backward in conjunction with the forward and backward movement of the support section 63.

Figure 7:
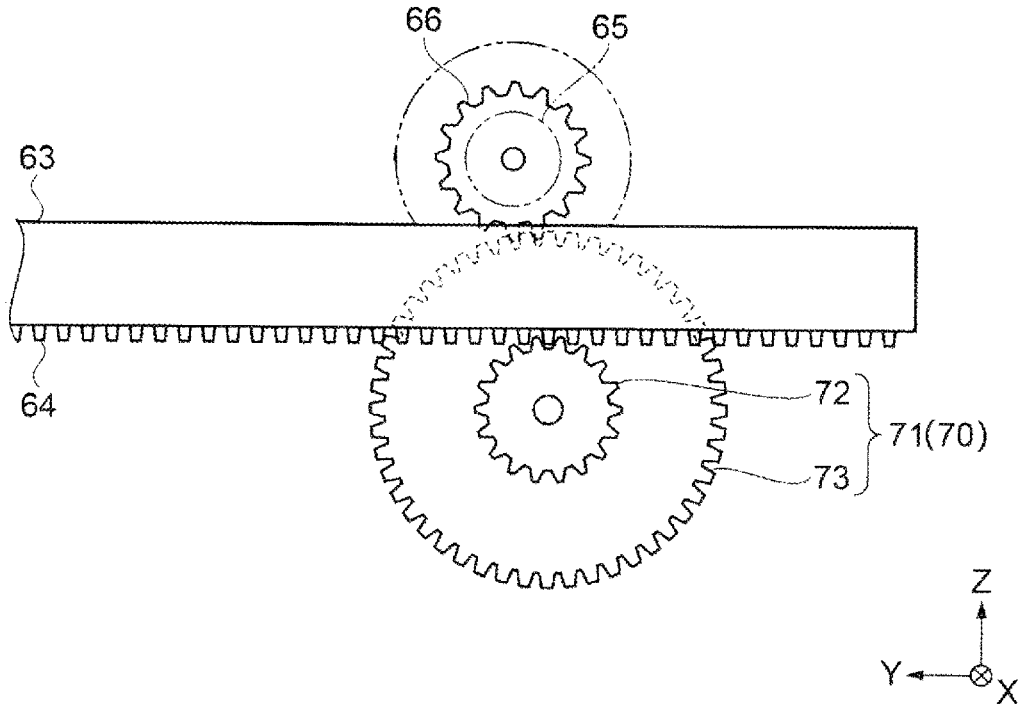
FIG. 7 is a side view of a power transmission configuration between a support section and a pivot shaft of the recording device according to the first embodiment as viewed from the side.
Figure 8:
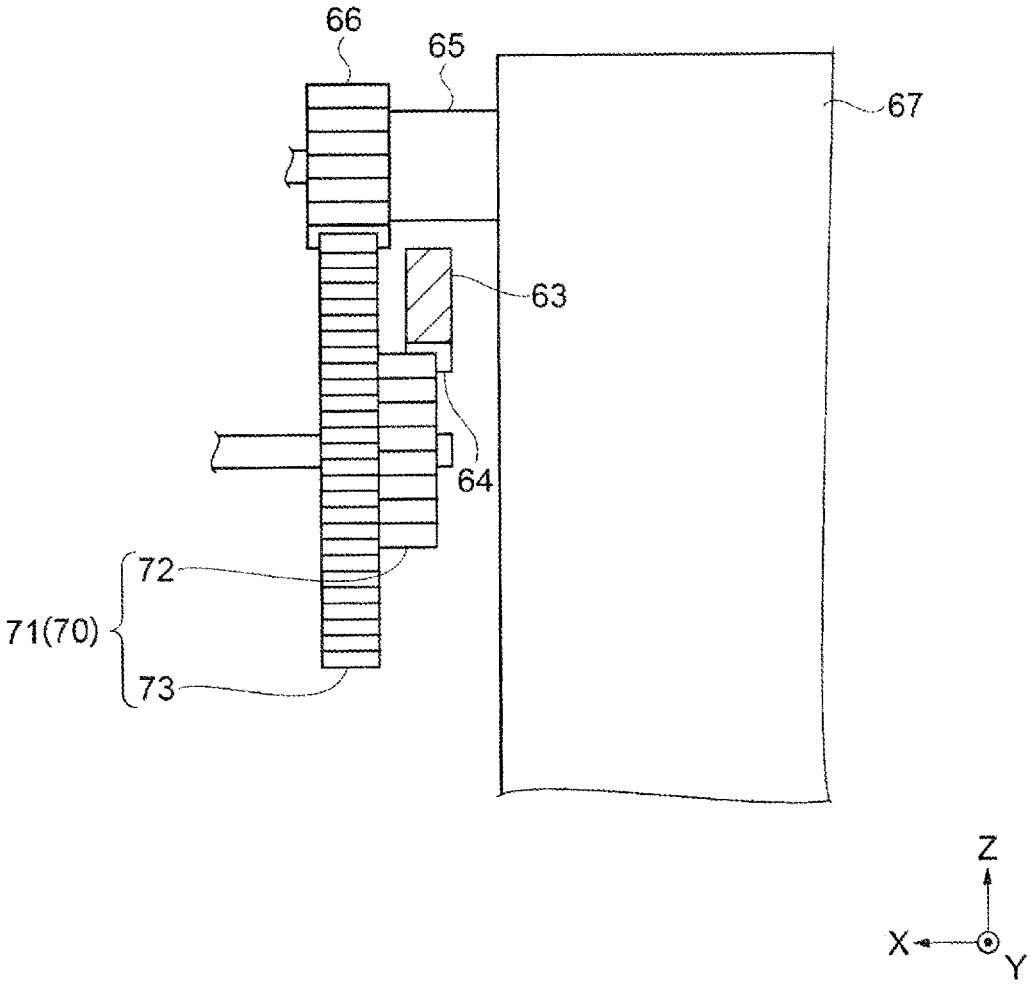
FIG. 8 is a front view of a power transmission configuration between a support section and a pivot shaft of the recording device according to the first embodiment as viewed from the front.

As shown in FIGS. 7 and 8, a rack 64 is provided on at least one of the pair of support sections 63. The rack 64 is formed by cutting a plurality of teeth at equal pitches on a plate-like bar. In the recording device 10 of the present embodiment, the racks 64 are provided on the −Z side surfaces of both of the support sections 63. On the other hand, a pivot shaft gear 66 is mounted on the pivot shaft 65. The pivot shaft gear 66 rotates in conjunction with the movement of the rack 64. Further, a speed enhancement mechanism 70 for increasing the rotational speed of the pivot shaft gear 66 is provided between the rack 64 and the pivot shaft gear 66.

The speed enhancement mechanism 70 has a first combination gear 71 as a composite gear in which gears having different numbers of teeth are stacked. In the first combination gear 71, a first gear 72 meshed with the rack 64, and a second gear 73 having a larger diameter and a larger number of teeth than the first gear 72 are formed on the same shaft. The rack 64 and the first gear 72 are engaged with each other so that a linear motion caused by the forward and backward movement of the support section 63 is converted into a rotational force of the first combination gear 71.

For example, when the number of teeth of the second gear 73 is twice the number of teeth of the first gear 72, the pivot shaft gear 66 engaged with the second gear 73 rotates twice as fast as when the first gear 72 and the pivot shaft gear 66 are directly engaged with each other. That is, the first combination gear 71 increases the speed of the rotation of the pivot shaft gear 66. In the present embodiment, the speed enhancement mechanism 70 constituted by one first combination gear 71 is exemplified, but the speed enhancement mechanism may be constituted by two or more combination gears. Further, the speed enhancement mechanism may be configured by combining a plurality of large and small spur gears having different diameters and different numbers of teeth.

Figure 4:
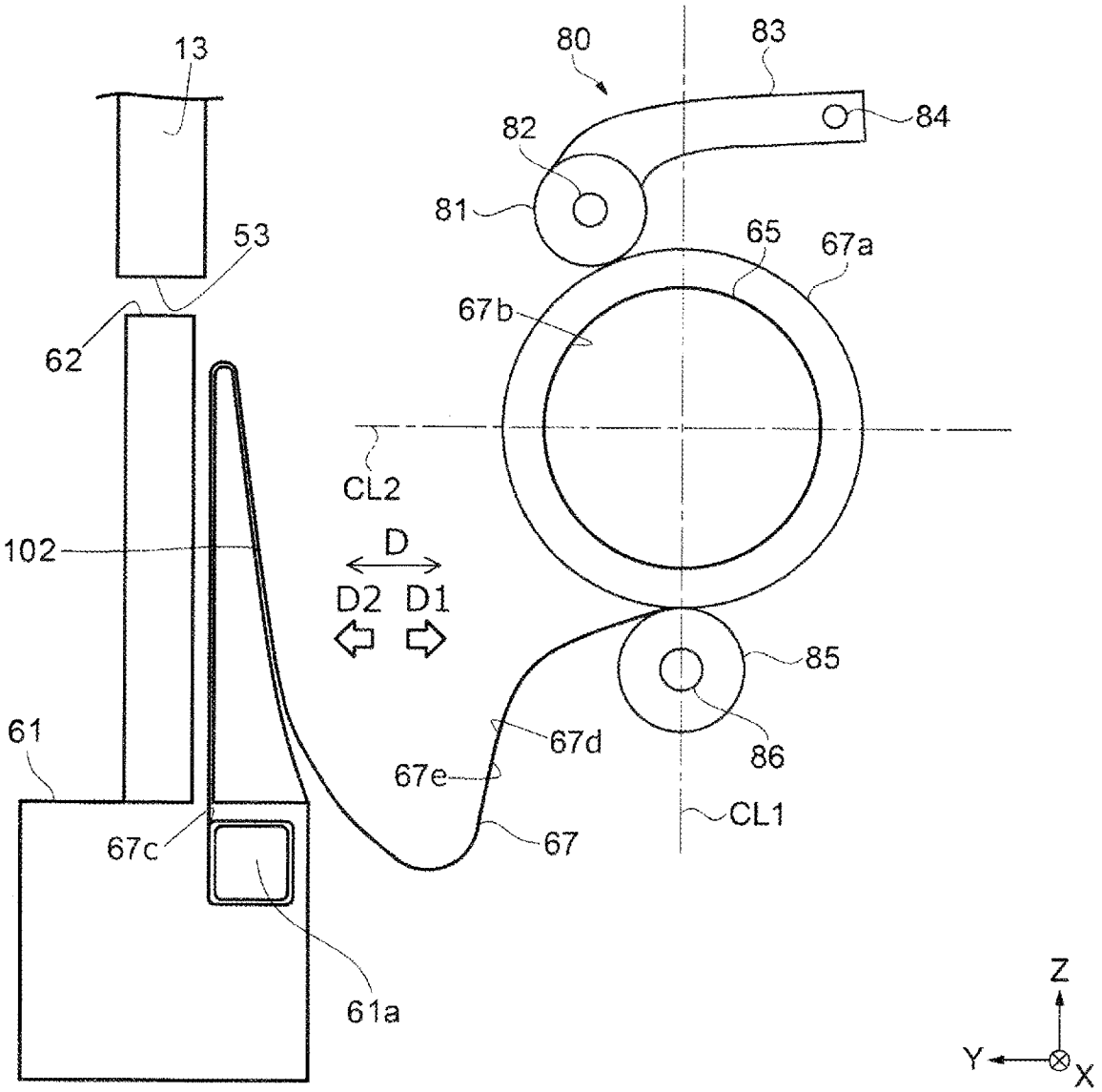
FIG. 4 is an enlarged view showing a portion corresponding to a region A in FIG. 3 in an enlarged manner, and is a view showing a mounted state.
Figure 5:
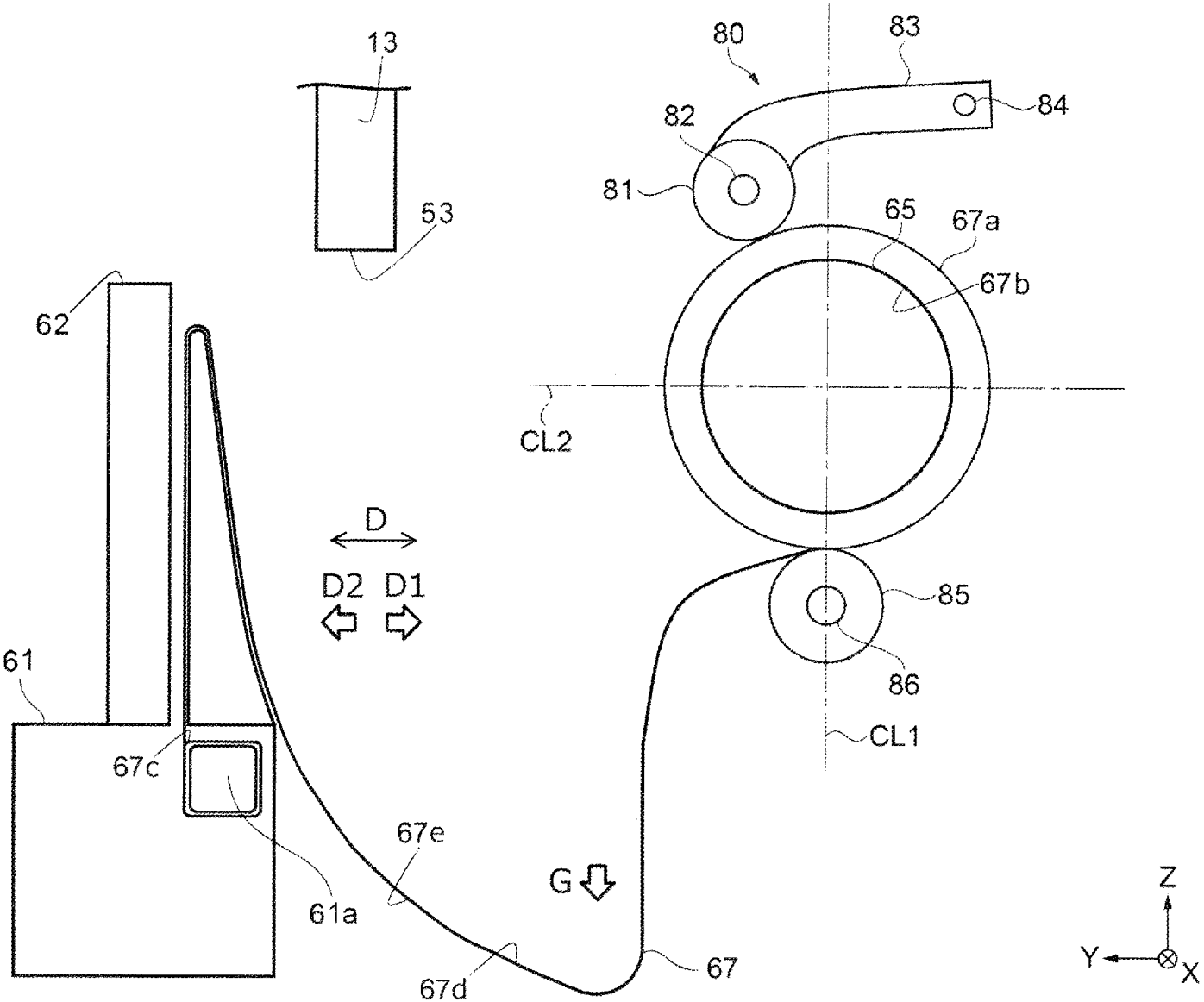
FIG. 5 is an enlarged view showing a portion corresponding to the region A in FIG. 3 in an enlarged manner, and is a view showing a state (separation start state) when the operation section starts to retract from the front wall of the housing from the state of FIG. 4.
Figure 6:
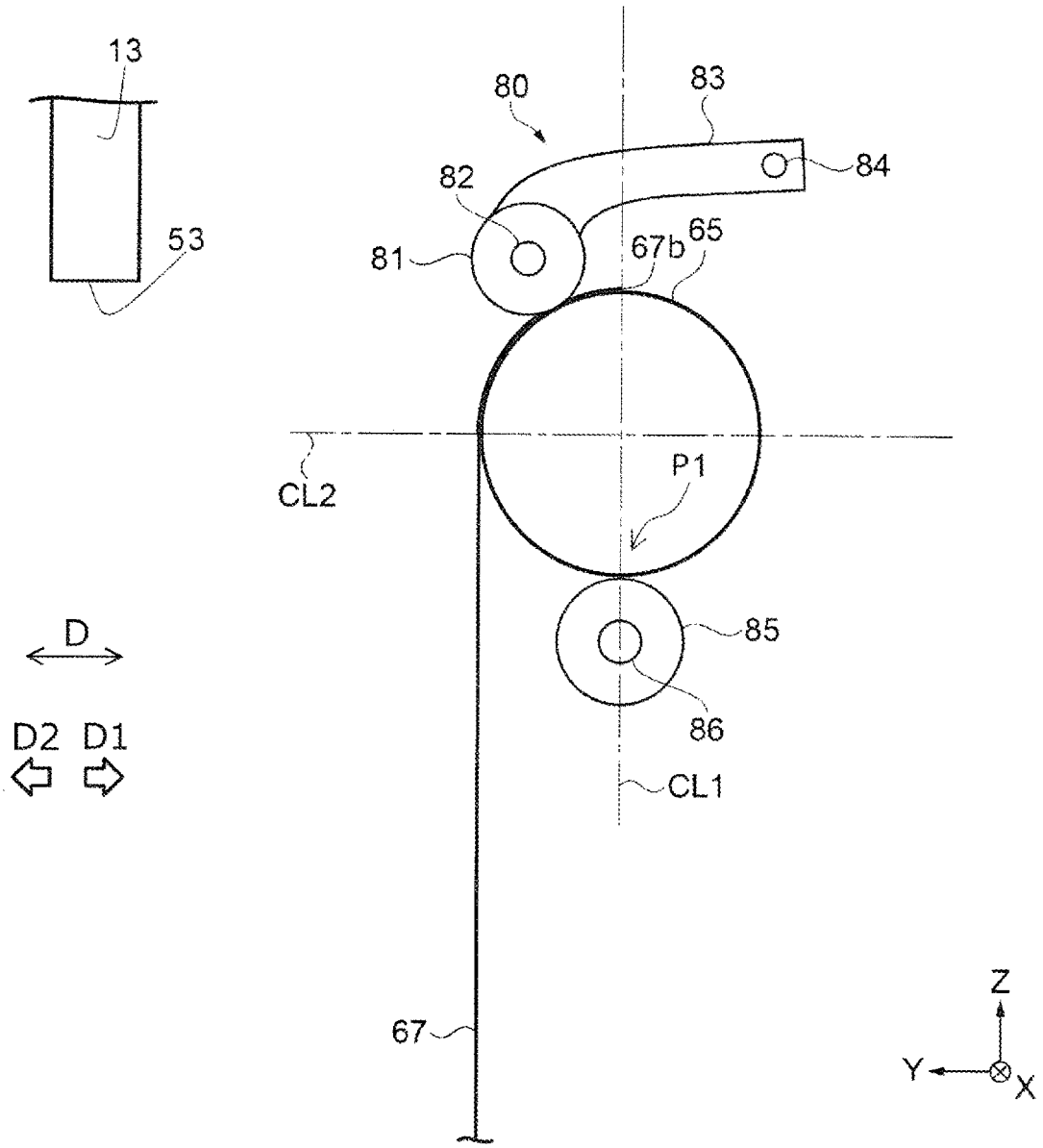
FIG. 6 is an enlarged view showing a portion corresponding to the region A in FIG. 3 in an enlarged manner, and is a view showing a separated state.

When the operation section 61 is displaced from the separated state shown in FIGS. 3 and 6 to the mounted state shown in FIG. 4 via the state shown in FIG. 5, the receiving member 67 is wound around the pivot shaft 65 and housed inside the housing 12. In addition, when the operation section 61 is displaced from the mounted state illustrated in FIG. 4 to the separated state illustrated in FIGS. 3 and 6 through the state of FIG. 5, the receiving member 67 is fed out from the pivot shaft 65 to the outside of the housing 12 via the lower side of the opening 53, and is in a state of being receivable the medium 22 discharged from the upper side of the opening 53. The recording device 10 of the present embodiment is configured such that the feeding amount of the receiving member 67 fed out from the pivot shaft 65 is larger than the movement amount of the pair of support sections 63 in the +Y direction by the speed enhancement mechanism 70. Accordingly, the receiving member 67 forms a slack between the operation section 61 and the pivot shaft 65.

The operation section 61 has the front plate 62 which forms a part of the front wall 13 of the housing 12 in the mounted state shown in FIG. 4. The front plate 62 is a plate-shaped member that is long in the X direction and rises in the +Z direction from the operation section 61. At least a part of the opening 53 is closed by the front plate 62 in the mounted state of the operation section 61. As shown in FIG. 4, the front plate 62 forms the same surface as the front wall 13 in the mounted state. In the present embodiment, the lower section of the opening 53 through which the receiving member 67 is fed out is closed by the front plate 62.

In the present embodiment, a configuration in which the advancing amount of the receiving member 67 is larger than the moving amount of the support section 63 by using the speed enhancement mechanism 70 is exemplified, but the present disclosure is not limited to this. For example, it is possible to realize a configuration in which the feeding amount of the receiving member 67 is larger than the movement amount of the support section 63 by using a pivot shaft having a circumference length longer than the movement amount of the support section 63 necessary for rotating the pivot shaft once.

As shown in FIGS. 4 to 6, the medium receiving section 60 has an abutment section 80 and an auxiliary roller 85. The abutment section 80 abuts against an outer circumferential surface 67*a* of the roll-shaped receiving member 67 wound around the pivot shaft 65 to press the receiving member 67 against the pivot shaft 65. The abutment section 80 is provided at both end sections in the axial direction of the pivot shaft 65, that is, in the X direction.

The abutment section 80 has an abutment roller 81 and an arm 83. The abutment roller 81 is a driven roller that is driven by being in contact with the outer circumferential surface 67*a* of the receiving member 67 that rotates together with the pivot shaft 65 when the receiving member 67 is wound around or unwound from the pivot shaft 65. The arm 83 is positioned above the pivot shaft 65. One end of the arm 83 is positioned in the −Y direction from the vertical line CL1 intersecting the axial line of the pivot shaft 65, and is rotatably supported by an arm shaft 84 extending in the X direction. The other end of the arm 83 is positioned in the +Y direction from the vertical line CL1, and rotatably supports the abutment roller 81 via an abutment roller shaft 82. That is, the abutment roller 81 abuts the roll-shaped receiving member 67 between a straight line extending in the +Z direction from the axis of the pivot shaft 65 in the vertical line CL1 and a straight line extending in the +Y direction from the axis of the pivot shaft 65 in the horizontal line CL2 intersecting with the axis of the pivot shaft 65. However, the abutment section 80 may not be disposed at such a position.

The abutment roller 81 presses the roll-shaped receiving member 67 wound around the pivot shaft 65 against the pivot shaft 65 by a pressing member (not shown) that presses the arm 83 downward. Thus, the abutment roller 81 can be brought into contact with the outer circumferential surface 67*a* of the receiving member 67 following the radius of the roll-shaped receiving member 67 which changes in accordance with the rotation of the pivot shaft 65. In the present embodiment, a configuration in which the abutment sections 80 are provided at both end sections of the pivot shaft 65 is exemplified, but a configuration in which a plurality of abutment sections is further provided in addition to both end sections may be employed.

The auxiliary roller 85 abuts on the outer circumferential surface 67*a* of the roll-shaped receiving member 67 wound around the pivot shaft 65 to press the receiving member 67 to the pivot shaft 65. The auxiliary roller 85 is a driven roller that is driven in contact with the outer circumferential surface 67*a* of the receiving member 67 that rotates when the receiving member 67 is unwound from the pivot shaft 65 or wound around the pivot shaft 65. The auxiliary roller 85 is positioned below a horizontal line CL2 intersecting the axial line of the pivot shaft 65, and is rotatably supported via an auxiliary roller shaft 86. Further, the auxiliary roller 85 is preferably provided at a position overlapping the vertical line CL1 intersecting the axial line of the pivot shaft 65.

The auxiliary roller 85 presses the roll-shaped receiving member 67 wound around the pivot shaft 65 to the pivot shaft 65 by a pressing member for pressing the auxiliary roller shaft 86 upward. Thus, the auxiliary roller 85 can be brought into contact with the outer circumferential surface 67*a* of the receiving member 67 following the radius of the roll-shaped receiving member 67 which changes in accordance with the rotation of the pivot shaft 65. One or more auxiliary rollers 85 are provided along the X direction of the pivot shaft 65.

The abutment roller 81 and the auxiliary roller 85 press the receiving member 67 against the pivot shaft 65, so that the rotation of the pivot shaft 65 is easily transmitted not only to the receiving member 67 close to the pivot shaft 65 but also to the outer circumferential surface 67*a* side. However, in the present embodiment, the receiving member 67 can be effectively extended from the pivot shaft 65 and hung downward. Therefore, even if the abutment roller 81 and the auxiliary roller 85 are not provided, the receiving member 67 can be normally extended. When the abutment roller 81 and the auxiliary roller 85 are not provided, the components associated with the abutment roller 81 and the auxiliary roller 85 are also unnecessary, and the cost can be reduced. In addition, since noise is not generated when the abutment roller 81 and the auxiliary roller 85 are driven and rotated by the feeding out and winding of the receiving member 67, noise is also reduced.

The rotation direction of the pivot shaft 65 when the receiving member 67 is fed out, in the order shown in FIGS. 4, 5, and 6, is clockwise in FIGS. 4 to 6. Conversely, when the receiving member 67 is wound around the pivot shaft 65 in the order shown in FIGS. 6, 5, and 4, the rotating direction of the pivot shaft 65 is counterclockwise in FIGS. 4 to 6.

In the present embodiment, the recording device 10 as a processing device provided with the recording section 30 for recording by the inkjet method as a processing section has been exemplified, but the present disclosure is not limited to this. The processing device may be a recording device other than an inkjet recording device, a copying device, a facsimile device, or a multifunction copier having a plurality of functions of these devices.

As described above, the recording device 10 is housed in the housing 12, and includes the recording section 30 as a processing section that processes the medium 22 and the medium receiving section 60 that receives the medium 22 discharged from the housing 12. The medium receiving section 60 includes the sheet-like receiving member 67 having flexibility, the pivot shaft 65 provided inside the housing 12 and coupled to one end 67*b* of the receiving member 67, the operation section 61 coupled to the other end 67*c* of the receiving member 67 and provided to be separable from the pivot shaft 65, and the pair of support sections 63 that protrude from the housing 12 advanceably and retractably in an advancing and retracting direction D along a direction (the +Y direction) which is shown in FIGS. 3 to 6 in which the operation section 61 is separated from the pivot shaft 65, and support both ends of the operation section 61. Further, as shown in FIGS. 7 and 8, the medium receiving section 60 has the rack 64 provided on at least one of the pair of support sections 63, and the pivot shaft gear 66 provided on the pivot shaft 65 and rotating in conjunction with the movement of the rack 64. A direction D1 of the advancing and retreating directions D in FIGS. 4 to 6 corresponds to the advancing direction of the operation section 61 into the housing 12, and a direction D2 of the advancing and retreating directions D in FIGS. 4 to 6 corresponds to the retreating direction of the operation section 61 from the housing 12.

A mechanism other than the combination of the rack 64 and the pivot shaft gear 66 may be employed as long as the pivot shaft 65 is configured to rotate in accordance with the movement of the operation section 61. For example, a configuration may be adopted in which the operation section 61 is supported on one end side of a rod-shaped guide member as the support section and the other end side of the rod-shaped guide member is supported by the housing 12. In this case, when the operation section 61 approaches or moves away from the housing 12, the other end side of the rod-shaped guide member supported by the housing 12 may operate to rotate as a fulcrum, and the rotation of the pivot shaft 65 may be interlocked with the rotation operation of the rod-shaped guide member.

Here, the receiving member 67 and the medium receiving section 60 will be described in more detail. The receiving member 67 of the present embodiment is configured to be wound around the pivot shaft 65 and housed inside the housing 12 when the operation section 61 approaches the pivot shaft 65, and to be unwound from the pivot shaft 65 and hang downward (a gravity direction G) to receive the medium 22 when the operation section 61 is separated from the pivot shaft 65. Accordingly, it is possible to house the medium receiving section 60 in a narrow space, and it is possible to provide a processing device in which the apparatus size is reduced.

The receiving member 67 sometimes happens to be pulled by the operation section 61 in the initial stage of separating the operation section 61 and feeding the receiving member 67 from the mounted state of the operation section 61 with respect to the housing 12 illustrated in FIG. 4. In the case, in FIG. 4, the receiving member 67 is pulled by the operation section 61, in the Z direction, at a height between the horizontal line CL2 intersecting the axial line of the pivot shaft 65 and the uppermost end of the pivot shaft 65, but the receiving member 67 may be supported by the operation section 61 so as to be pulled at a position lower than the horizontal line CL2 in the Z direction. When the receiving member 67 is supported so as to be pulled at a position lower than the horizontal line CL2 with respect to the operation section 61, the receiving member 67 is fed out easily downward. In a case where the receiving member 67 is supported at a position lower than the horizontal line CL2, the receiving member 67 may be supported by the operation section 61 at a position lower than the lowermost end of the pivot shaft 65 in the Z direction.

As illustrated in FIGS. 4 to 6, when the receiving member 67 is wound around the pivot shaft 65, a contacting side 67*d* which comes into contact with the medium 22 is on the inner side and the non-contact side 67*e* which does not come into contact with the medium 22 is on the outer side when the receiving member 67 is wound around the pivot shaft 65. In the initial stage of feeding out the receiving member 67, the feeding failure of the receiving member 67 is particularly likely to occur. However, as can be understood with reference to FIGS. 4 and 5, when the operation section 61 moves to be separated from the pivot shaft 65, the receiving member 67 is not fed out so as to jump out above the pivot shaft 65. With such a configuration, the receiving member 67 can be effectively extended from the pivot shaft 65 and hung downward. Therefore, in the recording device 10, it is possible to prevent the receiving member 67 from exceeding the operation section 61 and vigorously jumping out upward in the +Y direction and the receiving member 67 from being caught by the operation section 61 at the initial stage of feeding out the receiving member 67, and the receiving member 67 can be suitably fed out as shown in FIG. 3.

As described above, in the recording device 10 according to the present embodiment, when the operation section 61 moves to be separated from the pivot shaft 65, the receiving member 67 is fed out from the lower side of the pivot shaft 65. For this reason, in the recording device 10 of the example, it is possible to effectively feed out the receiving member 67 from the pivot shaft 65 and hang the receiving member 67 downward, and it is possible to suitably feed out the receiving member 67. The "lower side of the pivot shaft 65" means a lower side of a horizontal line CL2 intersecting with the axial line of the pivot shaft 65. However, for example, it may be allowed to be on the upper side of the horizontal line CL2 only in a part such as the end of feeding.

As described above, the recording device 10 of the present embodiment has the speed enhancement mechanism 70 between the rack 64 and the pivot shaft gear 66 for increasing the rotational speed of the pivot shaft gear 66 so that the amount of unwinding of the receiving member 67 is larger than the amount of movement of the pair of support sections 63. By adopting such a configuration, it is possible to easily form a configuration in which the pivot shaft rotates in conjunction with the operation of the operation section, and it is possible to eliminate the need to increase the size of the pivot shaft 65 for winding up the receiving member 67, thereby reducing the size of the apparatus.

Here, in the recording device 10 of the present embodiment, as illustrated in FIG. 6, the pivot shaft 65 is configured to further rotate by half-rotation from the position P1 at which the feeding amount of the receiving member 67 is maximum when the operation section 61 is most retracted with respect to the front wall 13 of the housing 12. As described above, it is preferable that the pivot shaft 65 is configured to be rotatable from the position P1 at which the unwinding amount of the receiving member 67 is maximum by a half-rotation or more. This is because the frictional resistance when the receiving member 67 comes into contact with the constituent members of the recording device 10 tends to increase at the end of the feeding of the receiving member 67, making it difficult to feed the receiving member 67, but by adopting such a configuration, the receiving member 67 can be suitably fed even at the end of the feeding of the receiving member 67. When the pivot shaft 65 is further rotated by a half rotation from the position P1 at which the feeding amount of the receiving member 67 can be maximized, the pivot shaft 65 is positioned on the outside of the medium receiving section 60 for receiving medium with respect to the sheet-like receiving member 67 having flexibility.

Second Embodiment

Figure 9:
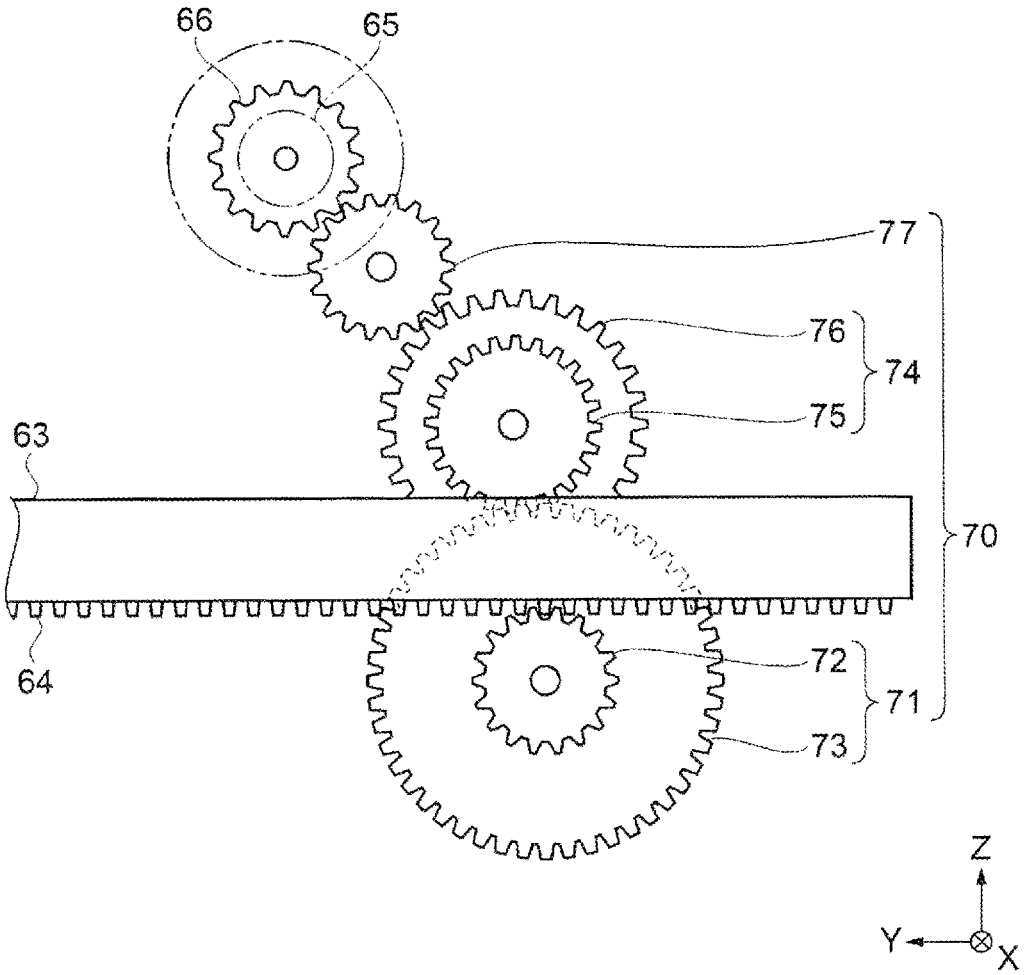
FIG. 9 is a side view of the power transmission structure between the support section and the pivot shaft of the recording device according to the second embodiment, as viewed from the side.

Hereinafter, the recording device 10 of a second embodiment will be described with reference to FIG. 9. FIG. 9 is a view corresponding to FIG. 7 in the recording device 10 of the first embodiment. The recording device 10 of the present embodiment is the same as the recording device 10 of the first embodiment except for the configuration described below. Therefore, the recording device 10 of the present embodiment has the same features as the recording device 10 of the first embodiment except for the points described below. Therefore, in FIG. 9, components common to those in the first embodiment are denoted by the same reference numerals, and a detailed description thereof is omitted.

As described above, in the recording device 10 of the first embodiment, the speed enhancement mechanism 70 is constituted by one combination gear (the first combination gear 71). On the other hand, as shown in FIG. 9, the speed enhancement mechanism 70 of the recording device 10 of the embodiment includes a second combination gear 74 in addition to the first combination gear 71 as a combination gear, and further includes a fifth gear 77 for adjusting the rotation direction of the pivot shaft gear 66 with respect to the movement direction of the rack 64 to a desired direction. In the second combination gear 74, a third gear 75 that meshes with the second gear 73 and that has a smaller diameter and a smaller number of teeth than the second gear 73 and a fourth gear 76 that has a larger diameter and a larger number of teeth than the third gear 75 are formed on the same shaft. The fifth gear 77 is configured to mesh with both the fourth gear 76 and the pivot shaft gear 66. As described above, the configuration of the speed enhancement mechanism 70 is not particularly limited, and the speed enhancement mechanism 70 can be configured by combining a plurality of gears.

The present disclosure is not limited to the above-described embodiments, and can be realized by various configurations without departing from the scope of the disclosure. In addition, the technical features in the embodiments corresponding to the technical features in the aspects described in the summary of the disclosure can be appropriately replaced or combined in order to solve a part or all of the problems described above or in order to achieve a part or all of the effects described above. In addition, if a technical feature is not described as an essential feature in the present specification, the technical feature can be deleted as appropriate.

What is claimed is:

1. A processing device comprising:

a medium processor that is housed in a housing and that processes a medium; and a medium receiving section that receives the medium discharged from the housing, wherein the medium receiving section includes a sheet-like receiving member having flexibility, a pivot shaft provided inside the housing and coupled to one end of the receiving member, an operation section coupled to the other end of the receiving member and provided separable from the pivot shaft, and a pair of supports that protrude from the housing advanceably and retractably in an advancing and retracting direction along a direction in which the operation section is separated from the pivot shaft, and that support both ends of the operation section, and wherein the receiving member is wound around the pivot shaft and housed inside of the housing when the operation section approaches the pivot shaft, and is unwound from the pivot shaft and hangs down receivable the medium when the operation section is separated from the pivot shaft, and is wound around the pivot shaft such that contacting side with the medium is an inner side when the receiving member is wound around the pivot shaft the pivot shaft is configured to be further rotatable by a half-rotation or more from a position at which a feeding amount of the receiving member is maximum.

2. The processing device, according to claim 1, wherein when the operation section is separated from the pivot shaft, the receiving member is fed from the lower side of the pivot shaft.

3. The processing device, according to claim 1, further comprising:

a rack provided to at least one of the pair of supports and a pivot shaft gear provided on the pivot shaft and configured to rotate in conjunction with the movement of the rack.

4. The processing device, according to claim 3, further comprising:

a speed enhancer provided between the rack and the pivot shaft gear, and increasing the speed of rotation of the pivot shaft gear to make the amount of delivery of the receiving member larger than the amount of movement of the pair of supports.

5. A recording device comprising:

a medium recorder that is housed in the housing and performs recording on a medium; and a medium receiving section that receives the medium discharged from the housing, wherein the medium receiving section includes a sheet-like receiving member having flexibility, a pivot shaft provided inside the housing and coupled to one end of the receiving member, an operation section coupled to the other end of the receiving member and provided separable from the pivot shaft, and a pair of supports that protrude from the housing advanceably and retractably in an advancing and retracting direction along a direction in which the operation section is separated from the pivot shaft, and that support both ends of the operation section, and wherein the receiving member is wound around the pivot shaft and housed inside of the housing when the operation section approaches the pivot shaft, and is unwound from the pivot shaft and hangs down receivable the medium when the operation section is separated from the pivot shaft, and is wound around the pivot shaft such that contacting side with the medium is an inner side when the receiving member is wound around the pivot shaft, and the pivot shaft is configured to be further rotatable by a half-rotation or more from a position at which a feeding amount of the receiving member is maximum.

* * * * *